United States Patent [19]

Craig

[11] 4,341,266

[45] Jul. 27, 1982

[54] PRESSURE OPERATED TEST TOOL

[75] Inventor: Gene C. Craig, Houston, Tex.

[73] Assignee: Lynes, Inc., Houston, Tex.

[21] Appl. No.: 187,283

[22] Filed: Sep. 15, 1980

[51] Int. Cl.[3] ..... E21B 34/10

[52] U.S. Cl. ..... 166/317; 166/321; 137/596.14

[58] Field of Search ..... 166/321, 317, 322, 323, 166/264; 137/625.6, 596.14

[56] References Cited

U.S. PATENT DOCUMENTS

| | | | |
|---|---|---|---|
| 3,664,415 | 5/1972 | Uray et al. | 166/321 |
| 3,976,136 | 8/1976 | Farley et al. | 166/362 |
| 4,064,937 | 12/1977 | Barrington | 166/321 |

*Primary Examiner*—James A. Leppink

*Attorney, Agent, or Firm*—William C. Norvell, Jr.

[57] ABSTRACT

A test tool is provided for testing the production capabilities of a preselected formation subsequent to the drilling of a subterranean well. The test tool is part of a testing string which incorporates a packer which may be releasably engaged in the casing string at a depth immediately above a region where formation testing is desired. The test tool includes a rotary ball valve which is normally maintained in a closed position during the insertion of the tool into the well. After setting of the packer, the ball valve is opened by increasing the fluid pressure existing in the annulus between the casing and the testing string. Such annulus pressure is applied to a first reservoir of trapped fluid which may contain water, and supplies fluid at annulus pressure to one side of a valve operating piston to shift the operating piston to actuate the rotary ball valve to its open position and compress a piston return spring. A second reservoir maintains a pressure equal to the hydrostatic pressure in the well at the selected depth. The control valve for the ball valve piston is a piston exposed at opposite ends respectively to the two trapped fluids, and hence is shiftable to a valve opening position by an increase in fluid pressure in the first reservoir over that in the second reservoir. When annulus pressure is reduced, the trapped pressure and a compressed spring in the second fluid reservoir shifts the control valve to cause closing of the ball valve. An over pressure valve which permits fluid pressure in the second reservoir to be increased in the event that a significant further increase in annulus pressure is encountered.

10 Claims, 8 Drawing Figures

PRESSURE OPERATED TEST TOOL

BACKGROUND OF THE INVENTION

1. Field of the Invention

The invention relates to a pressure operated test tool for use in a subterranean well.

2. Description of the Prior Art

During the course of drilling a subterranean well, the bore hole is filled with a fluid known as "drilling fluid" or "mud". One of the purposes, among others, of this drilling fluid is to contain in the intersected formations any fluid which may be found there. This is done by weighting the mud with various additives so that the hydrostatic pressure of the mud at the formation depth is sufficient to keep the formation fluid from escaping out of formation into the bore hole.

When it is desired to test the production capabilities of the formation, a test string is lowered into the bore hole to the formation depth and the formation fluid is allowed to flow into the string in a controlled testing program. Lower pressure is maintained in the interior of the test string as it is lowered into the bore hole, and this is usually done by keeping a valve in the closed position near the lower end of the test string. When the test depth is reached, a packer is set to seal the bore hole, thus isolating the formation from changes in the hydrostatic pressure of the drilling fluid.

The valve at the lower end of the test string is then opened and the formation fluid, free from the restraining pressure of the drilling fluid, can flow into the interior of the test string.

The test program includes periods of formation flow and periods when the formation is "closed in". Pressure recordings are taken throughout the program for later analysis to determine the production capabilities of the formation. If desired, a sample of the formation fluid may be caught in a suitable sample chamber.

At the end of the test program, a circulation valve in the test string is opened, and formation fluid in the test string is withdrawn.

In an off-shore location, it is desirable to the maximum extent possible, for safety and environmental protection reasons, to keep the blow-out preventers closed during the major portion of the testing procedure and to eliminate test string movement to operate down hole valves. For these reasons, test tools which can be operated by changing the pressure in the well annulus surrounding the testing string have been developed. See, for example, the disclosure of U.S. Pat. Nos. 3,664,415 to Ray, et al, 3,358,649 to Holden, et al, and 3,976,136 to Farley, et al, which patents disclose pressure operated test valves wherein the valve operating force is derived from the action of a trapped inert gas against a piston.

As discussed in the aforementioned patent to Holden, et al, a trapped gas system for operating a test valve necessarily requires the determination of the proper gas operating pressure at the test depth and the insertion of the gas in the tool at the well head at such pressure. In the event of unforeseen changes in the pressure at the formation depth, the test apparatus may readily become inoperative.

SUMMARY OF THE INVENTION

An improved test valve mechanism embodying this invention is incorporated in a test string which is provided at its lower portion with a packer for releasably engaging the well bore or the interior of the well casing at a region immediately above the formation to be tested. The primary operating valve for the test mechanism is preferably of the rotating hollow ball type so as to provide a minimum restriction in flow of well fluids through the bore of the testing string. An actuating piston is provided for such ball valve and is spring biased to its position corresponding to the closed position of the ball valve. When the test string is inserted in the well, the primary valve is in its closed position and both the interior of the test tool bore and the annulus are subjected to the hydrostatic pressure of the well fluids, which, at the test stage is generally a drilling fluid or mud.

Upon reaching test depth, the packer carried by the test string is set and the annulus between the test string and the well bore is thereby isolated from the well bore below the packer and the bore of the test tool, thereby relieving such regions from the hydrostatic pressure of the drilling mud and permitting flow of formation fluids into the bottom portions of the test string. To open the primary valve, an increased fluid pressure is provided to an end face of the valve actuating piston to move such piston in opposition to the spring force thereon. Such increased fluid pressure is provided by a clean fluid, generally water, which is isolated in a first chamber or reservoir contained in the same housing which mounts the primary valve and actuating piston. This fluid chamber is subjected to annulus fluid pressure through a floating piston disposed in the chamber and having one face in contact with the isolated fluid and the other face contacted by the annulus fluids through an appropriate port in the wall of the housing. The isolated fluid is not directly applied to the actuating piston but is applied through ports in an axially shiftable, piston type control valve. Such control valve has one piston face exposed to the first isolated fluid and a second piston face exposed to a second isolated fluid, generally an oil, which is contained within a second fluid chamber or reservoir provided in the valve mounting housing. The pressure in the second fluid chamber is determined by a second floating piston which has one face exposed to the second isolated fluid and the other face exposed to annulus fluids during the insertion of the test tool into the well bore. After the packer is set, however, and the annulus fluid pressure is increased by operation of an appropriate pump at the well head, a trap valve is operated to essentially form a third fluid chamber in contact with the other face of the second floating piston containing trapped well drilling fluids at the hydrostatic pressure existing at the selected depth where the testing is to be conducted.

Thus, during the insertion movement of the test tool into the well bore, and prior to operation of the trap valve, the pressure on the two opposed piston faces of the control valve are equal and the control valve is maintained in a position which does not supply the first isolated fluid to an operating face of the actuating piston. At the same time, the actuating piston is subjected on both end faces to pressures equal to the hydrostatic pressures of the well drilling fluid, and hence remains in its normally closed position. After setting of the packer, the pressure effects of the well drilling fluid on the actuating piston is nullified.

After operation of the trap valve by increasing the annulus fluid pressure by a pump at the well head, a further increase in such annulus fluid pressure effects an axial shifting of the control valve due to the fact that the fluid pressure of the first isolated fluid acting on the one face of the control valve exceeds the effective pressure exerted on the other face of the control valve by the second isolated fluid and a spring. The control valve then shifts axially to supply the pressured first isolated fluid to the end face of the piston in opposition to the spring forces thereon to cause the piston to move the primary valve to its open position.

To effect the closing of the primary valve, the annulus fluid pressure is reduced to the hydrostatic pressure level. The effective pressures on the opposed piston faces of the control valve are then such as to permit the spring to move the control valve to its original position wherein the first isolated fluid is no longer supplied to the actuating piston, and the small quantity of first isolated fluid that was in contact with the actuating piston is permitted to drain into the bore of the testing string. The actuating piston is then returned by its compressed spring to its normally closed position and the primary valve is thus moved to its closed position.

Several desirable auxiliary features may be conveniently provided in a valve mechanism embodying this invention. It often happens that the temperature of the oil trapped in the second fluid chamber and the drilling fluid trapped in the third fluid chamber may be significantly increased by formation fluids, thus causing these fluid pressures to substantially exceed the hydrostatic pressure of the annulus fluid. To eliminate such excessive pressure, a relief valve is provided between the third fluid reservoir and the fluid annulus to insure that the second and third fluid reservoir pressures will never be significantly greater than the annulus fluid pressure.

Under some conditions, an unanticipated large increase in annulus fluid pressure may occur during a test while the primary valve is in its opened position. Under these circumstances, the primary valve could not be closed, due to the fact that the annulus fluid pressure cannot be returned to its original level. To eliminate this problem, an over pressure valve is provided between the third reservoir and the annulus which is held in a normally closed position by a shearable mechanism such as a shear pin. Such shear mechanism is designed to shear and permit the valve to open if a significant increase in fluid annulus pressure over the normal pressure employed to open the primary valve is encountered. This permits the higher pressure annulus fluid to flow into the third reservoir chamber and exert a higher fluid pressure on the fluid trapped in the second reservoir chamber, thus providing the necessary pressure differential relative to the first reservoir chamber which will be effective to cause a shifting of the control valve and the actuation of the piston to close the primary valve when the annulus fluid pressure is reduced.

A test valve mechanism of this invention is particularly desirable for subsea wells where actuation of valves by manipulation of the tubing string is undesirable.

DESCRIPTION OF THE PREFERRED EMBODIMENTS

Figure 1:
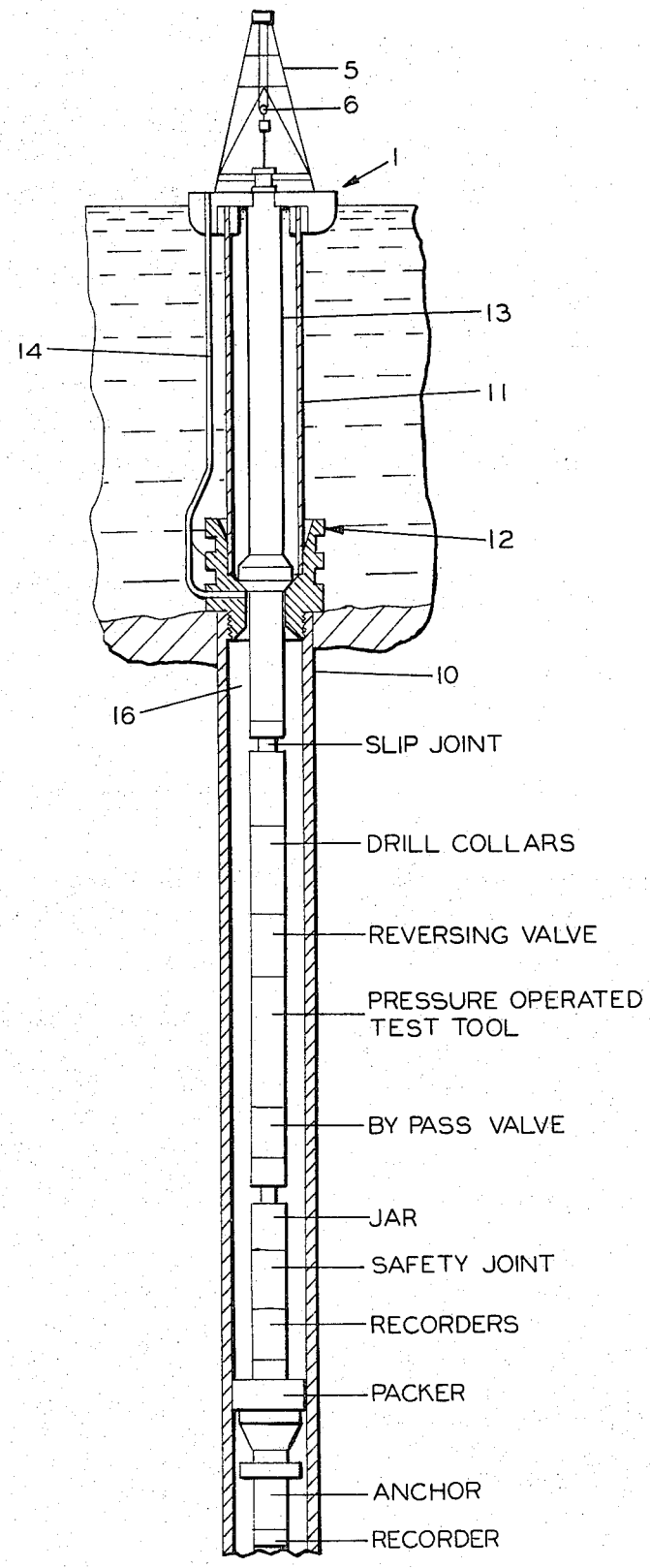
FIG. 1 is a schematic vertical sectional view of a typical subsea well installation incorporating a test tool constructed in accordance with this invention.

Referring initially to FIG. 1, a formation test mechanism is shown in assembled relationship in an off-shore well. Although the well may be an open hole it is usually cased as indicated at 10. A riser 11 normally extends from a subsea well head assembly 12 upward to a floating drill rig or platform 1 which is anchored or otherwise moored on location and is used to mount the pumps, hoists and other mechanisms normally employed in well testing. A test string 13 extends from the platform 1 downward into the well. A conventional derrick structure 5 on platform 1 provides a mounting for conventional hoisting means 6 by which the string 13 can be inserted in, and removed from, the well casing 10. A supply conduit 14 is provided to transmit fluid, such as drilling mud, to the annulus 16 between the testing string 13 and the casing 10 at a point below the blow-out preventers (not shown) which are conventionally incorporated in the well head 12. A pump (not shown) mounted on the platform 1 is provided to impart pressure to the fluid in conduit 14.

Included in the formation testing string 13 are a plurality of series connected, conventional components such as slip joints, drill collars, a reversing valve, a pressure operated test tool incorporating this invention, a bypass valve, a jar mechanism, a safety joint, pressure recorders, a settable packer, a perforated anchor, and another recorder to record formation pressures below the anchor if desired.

Figure 2:
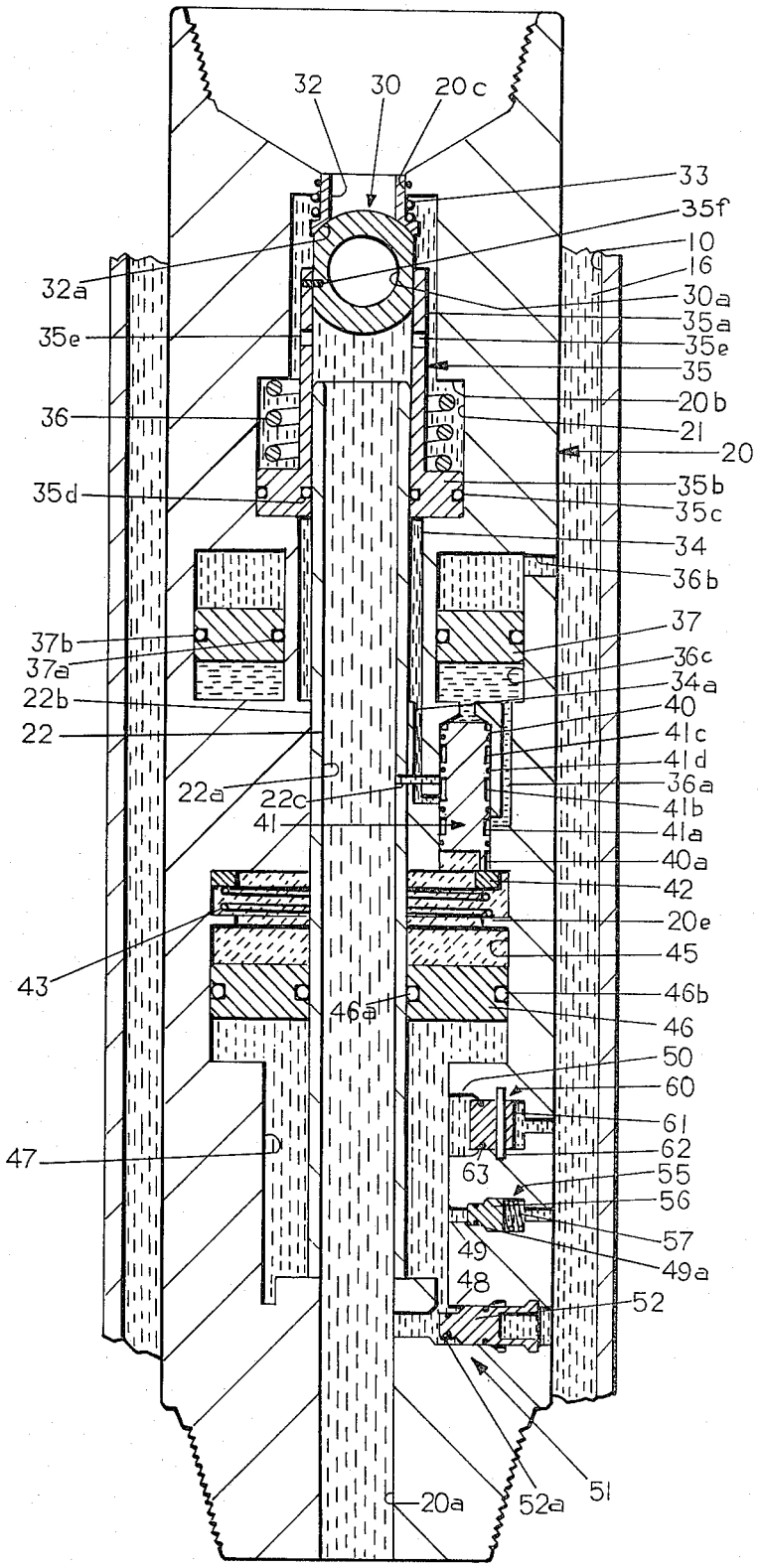
FIG. 2 is a schematic vertical sectional view of a test tool embodying this invention showing the elements of the tool in the positions occupied during the insertion of the tool into the bore or casing of the well.

Referring now to FIG. 2, there is schematically shown in vertical section a test tool 20 embodying this invention which is incorporated in the test string 13. The test tool 20 incorporates a primary valve 30 which is preferably of the rotatable hollow ball type having an aperture **30*a* therethrough which is substantially the same size as the bore 20*a* which extends axially through the testing tool 20. A conventional sleeve type actuating piston 35 is provided which is reciprocably mounted in the test tool 20 so as to rotate the primary ball valve 30 from the closed position shown in FIG. 2 to the open position shown in FIG. 3 by vertical upward movement of the piston 35**.

Piston 35 includes an annular body portion **35*a* which terminates at its lower end in an enlarged piston head portion 35*b*. The annular piston head portion 35*b* is sealingly engaged with the internal bore 21 provided in the body of the tool 20 by an annular seal 35c and with the exterior cylindrical surface 22b of a sleeve 22 co-axially mounted within the body 20 and having an internal bore 22a. An annular seal 35d sealingly engages the cylindrical sleeve surface 22b**.

A spring 36 operates between the top face of the piston portion 35b and an internal shoulder 20b provided in the tool body 20. Piston 35 is thus biased downwardly to a position wherein the rotary ball valve 30 is maintained in its closed position as illustrated in FIG. 2.

Figure 3:
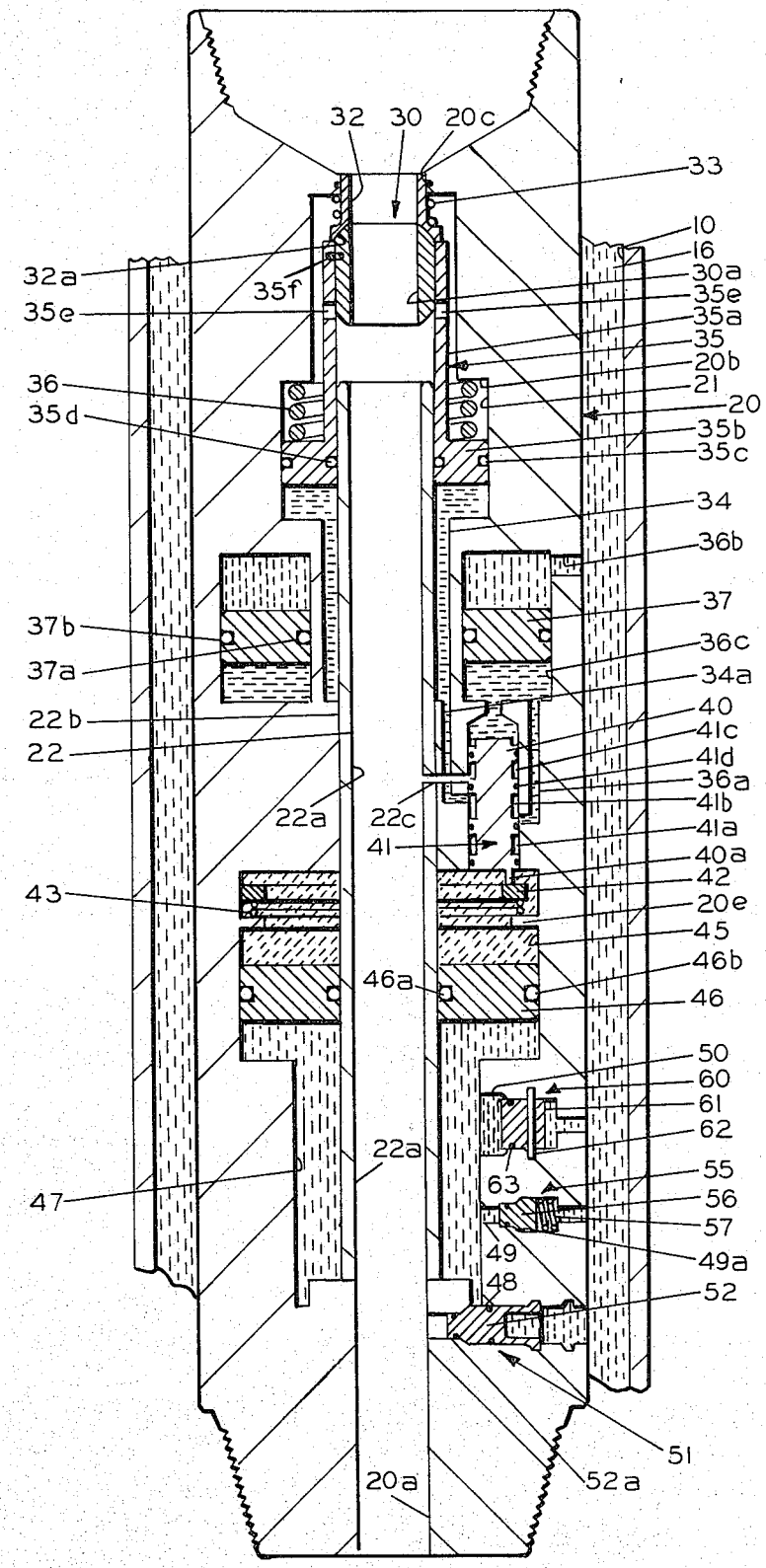
FIG. 3 is a view similar to FIG. 2 but showing the position of the components of the test tool after the packer has been set in the well bore and the annulus fluid pressure or mud pressure has been increased sufficient to cause opening of the primary valve of the test tool.

The piston 35 operates the rotary ball valve 30 in conventional fashion through the cooperation of a pin 35f carried by the sleeve portion 35a of the piston with a slot (not shown) formed in the external periphery of the rotary ball valve 30. Thus, upward movement of the piston 35 will effect a rotation of the ball valve 30 about a horizontal axis to bring the central passageway 30a into alignment with the bore 22a provided in the center of the test tool 20, as illustrated in FIG. 3.

In its closed position, the ball 30 seats against an annular seating surface 32a provided on the bottom end of a spring biased annular seat 32 which is mounted for reciprocal movements in a cylindrical wall portion 20c provided in the bore of the test tool 20. The seat 32a is resiliently held in engagement with the external spherical surface of the ball valve 30 by a spring 33.

Lastly, a plurality of radial ports 35e are provided in the cylindrical portion 35a of the actuating piston 35 to permit fluid entering the bore 22a to have free access to the chamber containing the top portions of the piston head 35b. Thus, as the test tool is initially lowered into the well, the bore 22a of the test tool 20 becomes filled with drilling mud or other fluid contained in the well bore and fills the cylinder chamber overlying the top surface of the piston head portion 35b. Hence, whatever hydrostatic fluid pressure exists in the drilling mud or other fluid contained in the well bore is applied to the valve actuating piston 35 in a direction to assist in maintaining the valve 30 in its closed position during the insertion movement of the testing string 13 containing the tool 20 in the well.

To effect an upward displacement of the actuating piston 35 to open the primary valve 30, a limited volume annular fluid chamber 34 is provided in the body of tool 20 immediately below the bottom face of the piston head portion 35b and surrounding sleeve 22. This chamber is filled with well fluids or drilling mud during insertion of the tool 20 in the well by a conduit 34a which is connected to a port 22c in sleeve 22 by a control valve 40. Such fluid is indicated by the short vertical hatched lines in all figures of the drawings.

During the insertion movement of the tool 20 into the well, the fluid contained in chamber 34 is therefore subjected to the hydrostatic pressure of the fluid existing in the well bore and the annulus and a balanced pressure is maintained on actuating piston 35.

A second annular chamber 36c is provided in tool body 20 which surrounds chamber 34 and has provided therein a floating piston 37. The lower face of piston 37 is in contact with trapped clean fluid such as water contained in reservoir 36c and trapped therein by virtue of a fluid connection 36a extending from reservoir 36c to a normally closed port on control valve 40. Such trapped fluid is indicated in the drawings by short horizontal hatched lines. The upper face of floating piston 37 is exposed to the hydrostatic pressure of the well fluids, or the annulus fluids after the packer has been set, by virtue of one or more radial ports 36b provided in the top portions of the chamber 36c. The sealing relationship of floating piston 37 to annular chamber 36 is maintained by a pair of annular seals 37a and 37b which respectively engage the inner and outer walls of the annular chamber 36c.

It is therefore apparent that if the control valve 40 is positioned so as to provide fluid communication between conduits 36a and 34a, then the hydrostatic pressure of the well fluids in annulus 16 after the setting of the packer, will be transmitted to the bottom face of the valve actuating piston 35b through the pressure forces developed on floating piston 37 and in turn transmitted to the annulus fluid trapped in chamber 34.

The control valve 40 comprises a cylindrical piston-like valve element 41 having a plurality of fluid transmitting annular recesses 41a, 41b, 41c on its periphery which are separated by sealing elements 41d which engage the interior walls of the bore in the tool body 20 within which the control valve element 40 is reciprocably mounted. The bottom end of control valve 40 is provided with an extension 40a which abuts a spring seat washer 42, which in turn is mounted within a second reservoir 45 containing a second trapped fluid indicated by short diagonal hatched lines in all figures of the drawings. A spring 43 is mounted between an internally projecting flange 20e provided in the reservoir 45 and urges the spring seat washer 42 upwardly, thus imparting an upward bias to the control valve element 40.

Figure 7:
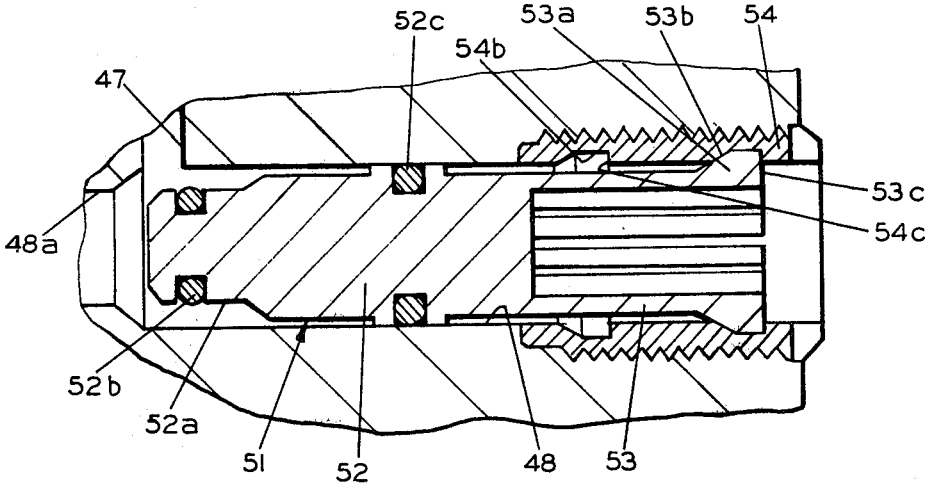
FIG. 7 is an enlarged scale partial sectional view of the trap valve employed in the lower portions of the test tool, with the valve shown in its open position.

The trapped fluid contained in the chamber or reservoir 45 is preferably a slightly compressible oil, such as a silicone oil. The pressure maintained on such oil is determined by an annular floating piston 46 which is mounted in the center of the chamber 45 and is sealingly engaged with the inner and outer walls thereof respectively by seal elements 46a and 46b. That portion of the chamber 45 which extends below the piston 46 communicates with a reduced diameter annular chamber 47. A plurality of radially disposed passages 48, 49 and 50 are respectively provided between the chamber 47 and the annulus 16 defined between the valve body 20 and the casing 10. Passage 48 also communicates with bore 20a. These radial passages are employed to respectively mount a trap valve 51, an internal pressure relief valve 55, and an excess annulus pressure compensating valve 60. The functions of these various valves will be described in detail below. It should be noted that the bottom portion of chamber 47 is in fluid communication with the bore 20a of the tool body 20 through the passage 48 when the trap valve 51 is in its open position, as illustrated in FIGS. 1 and 7. The trap valve 51 is, of course, disposed in its open position during the insertion of the pipe string 13 containing the tool 20 into the well.

Hence, the chamber 47 is in fluid communication with the well fluids or drilling mud contained in the well bore, as illustrated by the short vertical section lines in all figures of the drawings, and the hydrostatic pressure of such well fluids is transmitted to the lower face of the floating piston 46 and hence to the fluid trapped in the isolated upper portion of the chamber or reservoir 45. Thus, during the insertion of the testing tool into the well, the fluid pressures on the opposite ends of the control valve 40 are both equal to the hydrostatic pressure of the well fluids, and the control valve 40 remains in its upper position, as illustrated in FIG. 2, under the bias of the spring 43.

OPERATION

Assume now that the test string 13 has been lowered in the well so that the packer contained in such string is immediately above the formation to be tested. The packer is then set to effect a seal between the test string 13 and the casing 10 and thereby isolate the drilling mud contained in the annulus 16 from the formation which is to be tested, which is located below the packer. The pressure of the drilling mud contained in the annulus 16 is then increased through the operation of the pump located on platform 1 which communicates with such annulus through the conduit 14 (FIG. 1). As such annulus fluid pressure increases, the first effect is to cause the trap valve 51 to be moved from its open position shown in FIGS. 1 and 7 to its closed position illustrated in FIGS. 3 and 8.

Figure 8:
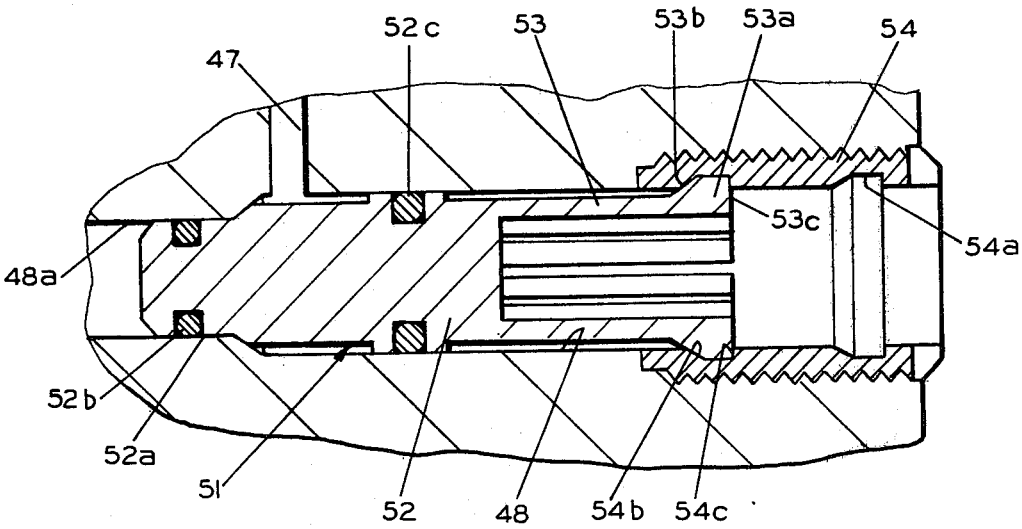
FIG. 8 is a view similar to FIG. 7 showing the trap valve in its closed position.

As best shown in FIGS. 7 and 8, the trap valve 51 comprises a plunger element 52 which is slidably mounted within the passage 48 provided in the valve body 20 and has a reduced diameter end portion **52*a* which, in the open position, is disposed in a large diameter portion of the passage 48. In the closed position of the valve, illustrated in FIG. 8, the small diameter end portion 52*a* sealingly engages a small diameter portion 48*a* of the passage 48 through the action of an O-ring seal 52*b* carried by the small end portion 52*a* and an O-ring seal 52*c* carried by the large diameter body portion 52 of the trap valve 51. The radially outer end of the valve plunger 51 is provided with a plurality of integral axially extending, annular segment splines to form a collet portion 53, which terminates in an enlarged end portion 53*a* having a sloped camming surface 53*b* on the inner face thereof and a generally radial end face 53*c*. In the open position of the trap valve 51, the enlarged end portions 53*a* are engaged in a correspondingly shaped recess 54*a* provided in a threaded sleeve 54 which is inserted in the valve body 20. As the annulus fluid pressure builds up, it quickly exceeds the pressure contained in the bore of the test tool 20 and the resulting differential force becomes large enough to cam the end portions 53*a* of the annular collet segments 53 inwardly and permit the valve body 52 to move inwardly to the closed position illustrated in FIG. 8. In this closed position, the radial end face 53*b* of the segmented collet portion 53 is engaged with a radially disposed locking face 54*c* of a recess 54*b* provided in the threaded sleeve 54, and hence the trap valve 51** is permanently locked in its closed position.

The effect of the locking of the trap valve 51 in its closed position is to isolate the drilling fluid or mud contained in the chamber extension 47 and the lower portion of the chamber 45 at the hydrostatic pressure that existed in the well bore at the position immediately above the formation to be tested. This then provides a reference pressure in the test tool which is, of course, transmitted to the trapped fluid contained in the reservoir 45 above the piston 46.

Referring now to FIG. 3, the annulus pressure has been increased to a significant value above that at which the trap valve 51 was actuated. This pressure is, of course, directly transmitted to the upper portions of the chamber **36*c* and hence transmitted to the first trapped fluid contained in the lower portions of the chamber 36*c*. Additionally, the pressure operating on the top end of the control valve 40 is increased over the pressure level working on the bottom end of such valve which is the pressure of the trapped fluid in the second chamber 45**, which is, of course, the reference pressure heretofore mentioned.

Thus, the control valve 40 is shifted downwardly, compressing the spring 43, to the position indicated in FIG. 3 wherein the fluid connection of passage **34*a* to the bore 22*a* is interrupted by the control valve 40 and a direct fluid connection is established between the trapped fluid in chamber 36*c* and the fluid in the small chamber 34. Thus, the increased annulus fluid pressure is transmitted directly to the bottom face of the actuating piston 35 and such piston is displaced upwardly against the bias of the spring 36. It should be noted that there is no substantial downward pressure on the actuating piston 35 because the fluid pressure within the bore 22*a* of the tool 20 remains at, or below the hydrostatic fluid level, since such bore is now open only to formation pressure. The upward movement of the actuating piston 35 produces a camming of the primary ball valve 30 to its open position, as illustrated in FIG. 3, and hence the fluids produced by the formation to be tested can flow freely into the bores 20*a* and 22*a* of the test tool 20 and thence upwardly through the string 13 to the well head, if such flow is desired. More importantly, the pressure of such formation fluids can be measured by the various recorders incorporated in the test string, as shown in FIG. 1**.

It is customary to conduct formation testing by opening the primary valve for a predetermined period, measuring flow rates and formation pressure, then closing the valve and measuring the resulting formation pressures, then reopening the valve, etc. Generally it is desirable to open and close the valve two or three or more times in order to provide adequate test data.

To effect the closing of the valve from the position illustrated in FIG. 3, it is only necessary to reduce the annulus fluid pressure to the original reference level. While the annulus fluid pressure was at its elevated level required to effect the opening of the primary valve 30, such excessive pressure was transmitted to the second isolated fluid contained in the reservoir 45 and trapped therein. This increase in pressure is occasioned by the downward movement of the control valve 40. It is for this reason that the fluid used in the second isolation reservoir should be slightly compressible in order to permit such limited movement of the control valve 40.

Figure 4:
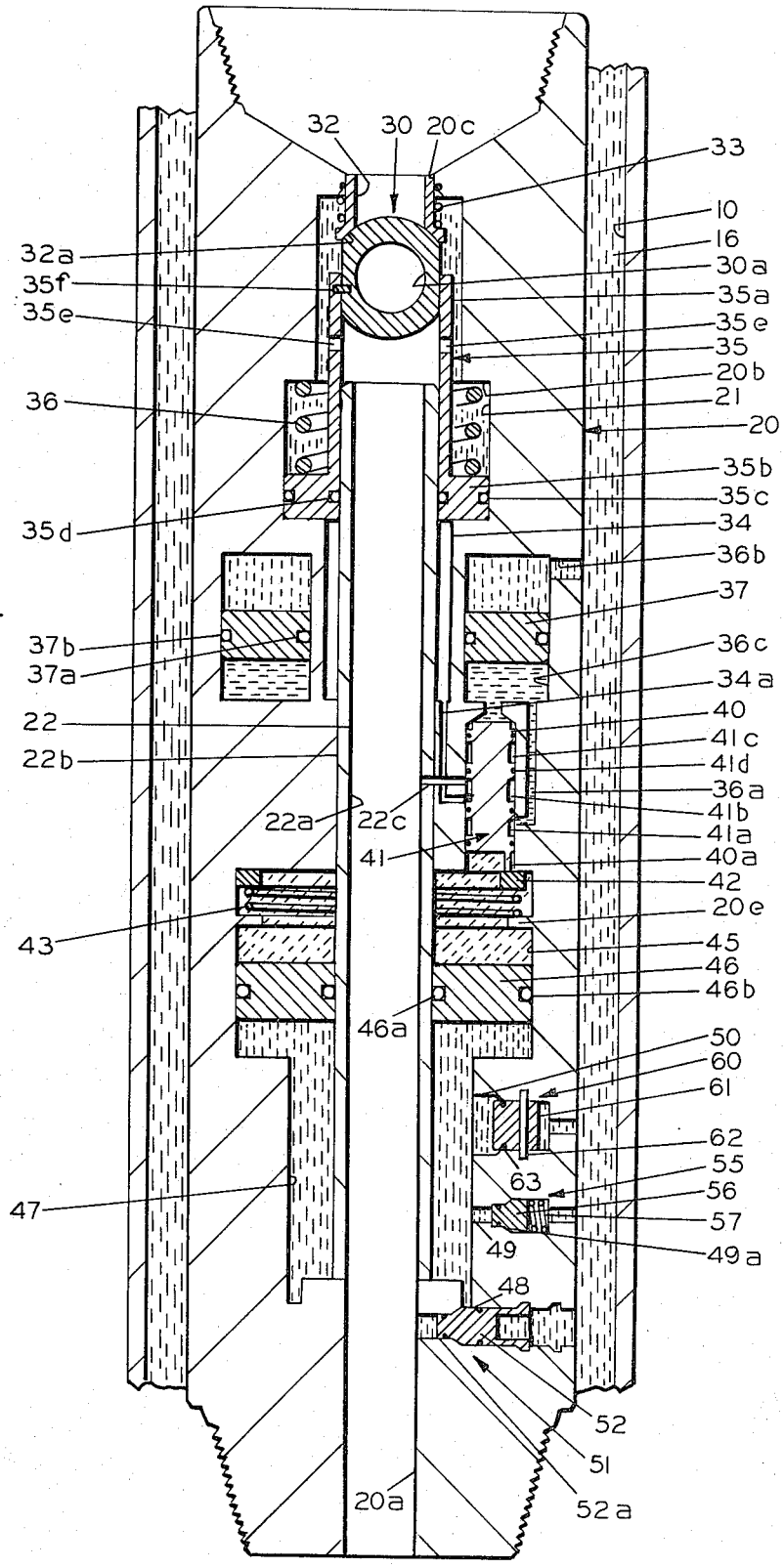
FIG. 4 is a view similar to FIG. 1, but showing the positions of the components of the test tool after a decrease in annulus fluid pressure or mud pressure is produced to effect the reclosing of the primary valve of the test tool.

Now, referring to FIG. 4, when the annulus fluid pressure is reduced to the reference level, the pressure trapped in the second isolated fluid in chamber 45 and compressed spring 43 will operate on the bottom face of the control valve 40 to shift such valve upwardly to its original position and this interrupts fluid communication between the bottom portion of chamber **36*c* and the chamber 34. In fact, the chamber 34 is connected through the control valve 40 to the radial conduit 22*c* to effect a draining of the limited quantity of fluid contained within the small volume chamber 34 into the bore 22*a* of the tool. Thus, the effective upward pressure forces on the actuating piston head portion 35*b* are dissipated and such piston is returned to its initial position, as illustrated in FIG. 4, through the action of the spring 36. The primary valve 30** is thus closed.

Thus all components of the apparatus are returned to the position illustrated in FIG. 4, but the primary valve 30 may again be opened by increasing the annulus pressure sufficient to shift the valve 40 and produce transmission of pressure to the actuating piston 35 to effect its upward movement and the rotation of the primary valve 30 to the open position.

The amount of fluid lost from the reservoir 36c with each cycle of operation of the primary valve determines the number of times that the valve can be cycled. Obviously, when sufficient fluid is lost from such valve by successive drainages of the small volume reservoir 34 during the closing portion of the cycle, the floating piston 37 will be approaching the bottom of the large volume reservoir 36c. Once it contacts the bottom of such reservoir, it obviously cannot transmit the increase in annulus pressure to effect the shifting of the control valve 40 and the opening of the primary valve. Generally the relative volume of reservoir 36c is selected to provide three opening and closing cycles.

Figure 5:
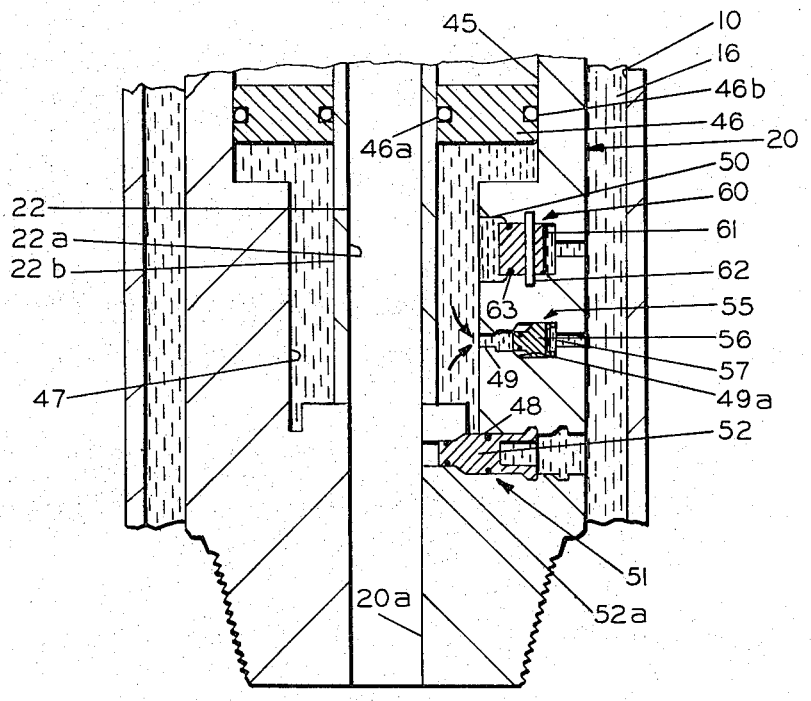
FIG. 5 is a view of the lower portions of FIG. 2, but illustrating the operation of the internal pressure relief valve.

In some cases, the temperature at the testing level may increase so that a significant increase in pressure of the trapped drilling mud contained in the lower portion of chamber 45 and extension chamber 47, as well as the oil contained in the top portions of chamber 45, will occur. Since this increased pressure would make the opening of the primary valve 30 more difficult, a pressure relief valve 55 is provided to maintain a predetermined limit to the increase of internal pressure in the tool relative to the hydrostatic pressure existing in the annulus. Relief valve 55 is of conventional construction including a valve plunger 56 which is biased against a seat 49a suitably provided in the passage 49 by a spring 57. The open position of the relief valve 55 is shown in FIG. 5.

A further feature of the test tool embodying this invention is the provision of means for compensating for an unanticipated increase in annulus fluid pressure while the primary valve 30 is in its open position. It will be obvious that if such unanticipated increase occurs, it will be impossible to reduce the annulus pressure to a level sufficient to effect the reclosing of the valve. To eliminate this possibility, the over pressure compensating valve 60 is provided. Valve 60 comprises a valve body 61 slidably mounted in a small diameter portion of passage 50 and secured in a closed or sealing position by a shear pin 62. In the closed position, the passage of fluid is effectively prevented by an O-ring seal 63 carried on the periphery of the valve body 61.

Figure 6:
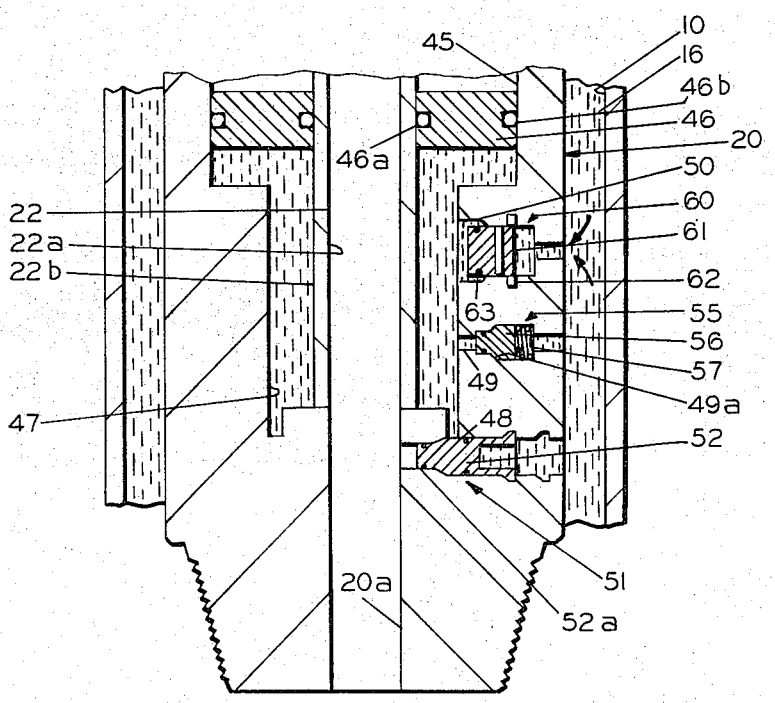
FIG. 6 is a view similar to FIG. 5 but illustrating the operation of the compensating valve for an unanticipated increase in fluid annulus pressure encountered when the primary valve is open.

Upon the occurrence of a predetermined increase in the annulus fluid pressure above the reference pressure, the resulting differential force on the valve body or plunger 61 will be sufficient to effect the shearing of pin 62, with the resulting inward displacement of the plunger 61, so that the seal 63 is no longer in engagement with the walls of the passage 50, thus permitting annulus fluid to flow into the reservoir extension 47 and equalize the pressure in such extension with that existing in the annulus (FIG. 6). Thus, in effect, the reference pressure trapped in the tool has been increased to correspond to the new unanticipated high level of annulus fluid pressure, to effect the operation of the valve mechanism to close the primary valve 30 in the same manner as heretofore described.

It will be apparent to those skilled in the art that the aforedescribed test valve provides a simple, essentially foolproof mechanism for effecting successive fluid pressure operations of a primary valve as required for the testing of well formations. Not only will the described valve mechanism function reliably under normal conditions, but will provide equally reliable operation under excessive internal pressure conditions produced by high temperatures in the vicinity of the formation being tested, or by unanticipated increases in annulus fluid pressure during the time that the test valve is open.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A primary valve for use in a subterranean well test string positionable in a well bore and having a packer arranged for selectively sealing the well bore to isolate the annulus between the well bore and the test string above the packer from that portion of the well bore below the packer, comprising: means for mounting said primary valve in said test string for movement between an open and closed position relative to the interior of said test string; an actuating piston for shifting said primary valve between said open and closed positions; resilient means urging said actuating piston to its valve closing position; a first fluid reservoir containing an isolated fluid; a shiftable control valve for selectively connecting one end of said piston to one of said first fluid reservoir and said test string bore, said control valve having opposed piston faces, one piston face on said control valve being exposed to said isolated fluid; means responsive to an increase in annulus pressure above well bore hydrostatic pressure for increasing said isolated fluid pressure to shift said control valve to cause said isolated fluid to open said primary valve; and means including said other piston face responsive to a subsequent decrease in annulus pressure to well bore hydrostatic pressure for shifting said control valve to remove the isolated fluid from said actuating piston, thereby permitting said primary valve to be closed by said resilient means.

2. A primary valve for use in a subterranean well test string positionable in a subterranean well bore and having a packer arranged for selectively sealing the well bore to isolate the annulus between the well bore and the test string above the packer from that portion of the well bore below the packer, comprising: means for mounting said primary valve in said test string for movement between an open and closed position relative to the interior of said test string; an actuating piston for shifting said primary valve between said open and closed positions; resilient means for urging said actuating piston to its valve closing position; a first fluid reservoir containing a first isolated fluid; a shiftable control valve for selectively connecting one end of said piston to one of said first fluid reservoir and said test string bore, said control valve having opposed piston faces, one piston face on said control valve being exposed to said first isolated fluid; means responsive to an increase in annular pressure above well bore hydrostatic pressure for increasing said first isolated fluid pressure to shift said control valve to cause said isolated fluid to open said primary valve; biasing means opposing such shifting of said control valve; a second fluid reservoir containing a second isolated fluid, the other piston face on said control valve being exposed to said second isolated fluid; and means for maintaining the pressure of said second isolated fluid at the level of the well bore hydrostatic pressure, whereby a subsequent decrease in annulus fluid pressure to the original well bore hydrostatic pressure causes a shifting of said control valve to remove the first isolated piston fluid from said actuating piston, thereby permitting said primary valve to be closed by said resilient means.

3. The apparatus defined in claim 1 or 2 wherein said first fluid reservoir comprises a chamber having one end thereof in fluid communication with said one piston face of the control valve and the other end thereof defined by a floating piston, and means for supplying annulus fluid pressure to the other side of said floating piston.

4. The apparatus defined in claim 2 wherein said second fluid reservoir has one end thereof in fluid communication with said other piston face of said control valve and the other end of said second fluid reservoir being defined by a floating piston, means including a third fluid reservoir for applying well bore hydrostatic fluid pressure to the other face of said floating piston, and a normally open trap valve disposed between said third fluid reservoir and said annulus, said trap valve having means thereon for releasably retaining the trap valve in said open position, said trap valve being movable to closed position to maintain the fluid pressure in said third reservoir.

5. The apparatus defined in claim 4 wherein a pressure relief valve is incorporated between said third fluid reservoir and said annulus, said relief valve being effective to relieve pressure increases in said second and third fluid reservoirs produced by heating of the trapped fluids therein.

6. The apparatus defined in claim 4 further comprising a valve communicating between said third fluid reservoir and said annulus and normally maintained in a closed position by a shearable pin, said pin shearing when the annulus pressure exceeds a predetermined limit over the normal increase in annulus fluid pressure utilized to effect the opening of the primary valve.

7. The apparatus defined in claim 5 further comprising a valve communicating between said third fluid reservoir and said annulus and normally maintained in a closed position by a shearable pin, said pin shearing when the annulus pressure exceeds a predetermined limit over the normal increase in annulus fluid pressure utilized to effect the opening of the primary valve.

8. The apparatus of claim 4 wherein said trap valve latching means comprises a collet portion having latching surfaces on its free ends.

9. The apparatus defined in claim 1, 2, 4, 5, 6 or 7 wherein said primary valve constitutes a ball valve member having an axial passage therethrough of a diameter approximating the bore diameter of the test string, and said actuating piston comprises an annular member surrounding said ball valve member and having a camming means in engagement with said ball valve member to effect the rotation of the ball valve member between its normally closed and its open position.

10. The apparatus defined in claim 1, 2, or 4 wherein each fluid reservoir comprises an annular chamber surrounding the bore of the test string.

* * * * *